United States Patent [19]

Watts

[11] 3,965,965

[45] June 29, 1976

[54] METHOD AND APPARATUS FOR CONTINUOUS CASTING OF METAL TUBING

[75] Inventor: Leonard Watts, Cedarhurst, N.Y.

[73] Assignee: Technicon Instruments Corporation, Tarrytown, N.Y.

[22] Filed: Dec. 19, 1974

[21] Appl. No.: 534,244

[52] U.S. Cl. ..... 164/83; 164/85; 164/274

[51] Int. Cl.[2] ..... B22D 11/04; B22D 11/08

[58] Field of Search ..... 164/71, 82, 83, 85, 164/274, 281, 136, 260, 282

[56] References Cited

UNITED STATES PATENTS

| | | | |
|---|---|---|---|
| 2,123,660 | 7/1938 | Pike | 164/281 X |
| 2,130,202 | 9/1938 | Tama | 164/83 X |
| 2,941,266 | 6/1960 | Ostermeyer et al. | 164/85 |
| 3,410,333 | 11/1968 | Woodburn, Jr. | 164/85 X |

FOREIGN PATENTS OR APPLICATIONS

| | | | |
|---|---|---|---|
| 877,940 | 5/1953 | Germany | 164/85 |
| 39,345 | 11/1970 | Japan | 164/85 |

*Primary Examiner*—Ronald J. Shore
*Assistant Examiner*—Gus T. Hampilos
*Attorney, Agent, or Firm*—S. P. Tedesco; Stephen E. Rockwell

[57] ABSTRACT

Method and apparatus for continuously casting metal tubing, utilizing an oscillatable mold, which lends itself to the casting of tubing of relatively large internal diameter. Molten metal is poured directly into the mold having a chilled axial wall structure, and then a starting bar, having at least an annular end portion immersed in the molten metal in the mold, is moved relatively to the mold to withdraw the solidifying cast metal tubing adhering thereto, during oscillation of the mold, the molten metal for such tubing being supplied from the mold. The supply of molten metal in the mold may be replenished by pouring additional molten metal directly into the mold through the annular starting bar without contact of the molten metal with either the starting bar or the solidifying tubing prior to the entry of such molten metal into the mold.

16 Claims, 3 Drawing Figures

FIG. 1
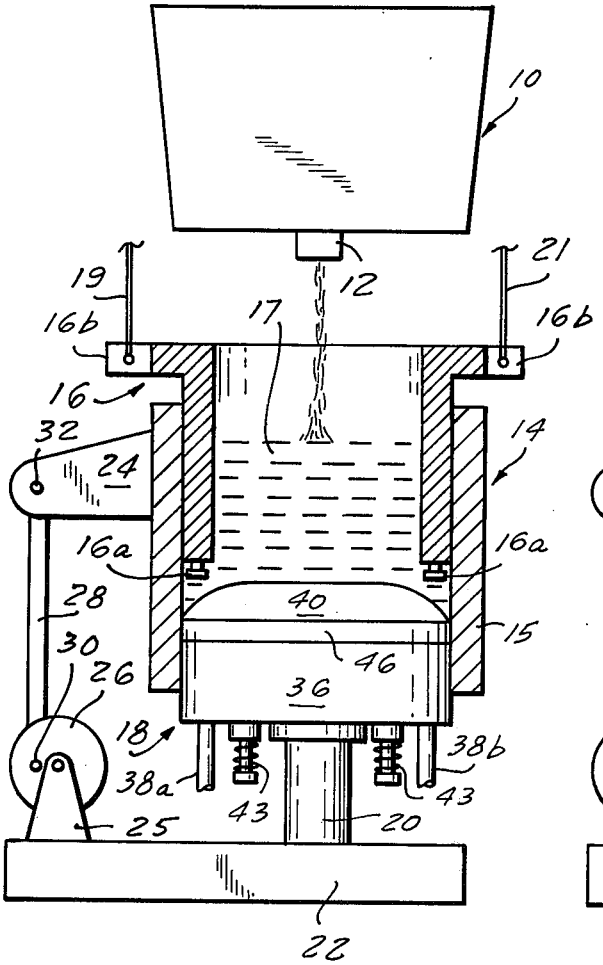
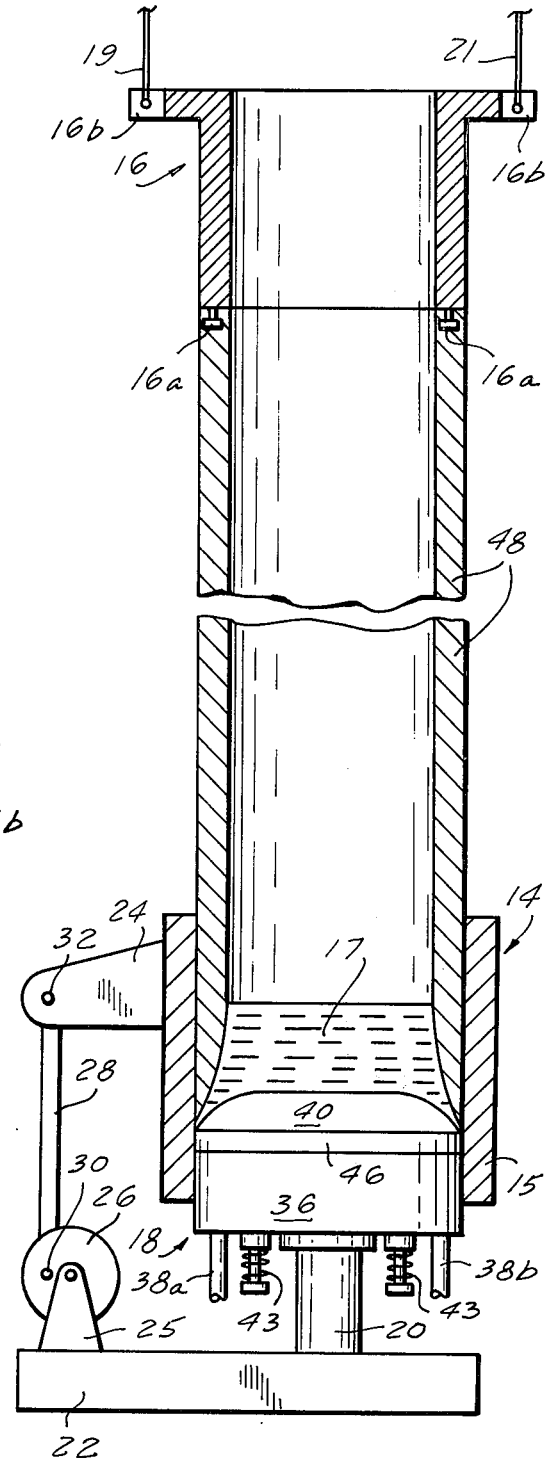
FIG. 2

METHOD AND APPARATUS FOR CONTINUOUS CASTING OF METAL TUBING

BACKGROUND OF THE INVENTION

1. Field of the Invention

This invention relates to the continuous casting of metal tubing.

2. Prior Art

Heretofore metal tubing has been cast or proposed for casting by a variety of techniques. My U.S. Pat. No. 3,680,624, Woodburn, Jr. U.S. Pat. No. 3,410,333, Tarmann U.S. Pat. No. 3,346,036, and Byrnes U.S. Pat. No. 750,253 are believed to be representative of the prior art.

In my aforementioned U.S. Pat. No. 3,680,624 a closed-end mold is utilized in a process of continuously casting metal tubing. The process includes forming a solidified shell of a tube about a molten core in contact therewith, molten metal from the source flowing through the shell toward the mold during separation of the mold and the source. The source includes a starting bar, and on termination of the flow from the source continuing relative separation of the source and the mold utilizes the molten metal in the shell as a source to form additional solidified shell as the level of the source in the shell drops, leaving behind it a hollow tube while the source in the shell diminishes. In Woodburn, Jr. U.S. Pat. No. 3,410,333 a pressurized source of molten metal is utilized to flow metal upwardly in a tube into a mold from which a casting in the form of a tube is drawn.

The aforementioned Tarmann U.S. Pat. No. 3,346,036 discloses casting tubing in which molten metal is poured in the top of an open-ended mold for continuous casting and a partially solidified casting is withdrawn from the mold and guided along an initially descending and then ascending, curved path to a level in which the liquid part of the casting cannot rise further so that the liquid metal inside the casting rises only to the pouring level. The tube is drawn off above this level from this curved portion of the casting.

Byrnes, U.S. Pat. No. 750,253 discloses a technique of casting a tubular article employing a mandrel for shaping the solidifying casting therearound as the casting is drawn off the mandrel. The mandrel is located centrally with reference to chilling and forming mold and has reciprocating movement with respect thereto and with reference to the source of molten metal for the supply of molten metal to the mold.

The present invention overcomes the difficulties associated with the prior art techniques and apparatus described above.

SUMMARY OF THE INVENTION

The present invention provides a method and apparatus for casting metal tubing, utilizing an oscillatable mold, which lends itself to the casting of tubing of relatively large internal diameter. Molten metal is poured directly into the mold having a chilled axial wall structure, and then a starting bar having at least an annular end portion immersed in the molten metal in the mold is moved relatively to the mold to withdraw the solidifying cast metal tubing adhering thereto, during oscillation of the mold, the molten metal for such tubing being supplied from the mold. The supply of molten metal in the mold may be replenished by pouring additional molten metal directly into the mold through the annular starting bar without contact of the molten metal with either the starting bar or the solidifying tubing prior to the entry of such molten metal into the mold.

BRIEF DESCRIPTION OF THE DRAWINGS

In the drawing:

FIG. 1 is a side elevational view in median section of casting apparatus embodying the invention;

FIG. 2 is a similar view omitting the source of metal supply from which molten metal is poured and showing the apparatus in a later condition during a casting operation.

DETAILED DESCRIPTION OF THE PREFERRED EMBODIMENT OF THE INVENTION

Figure 3:
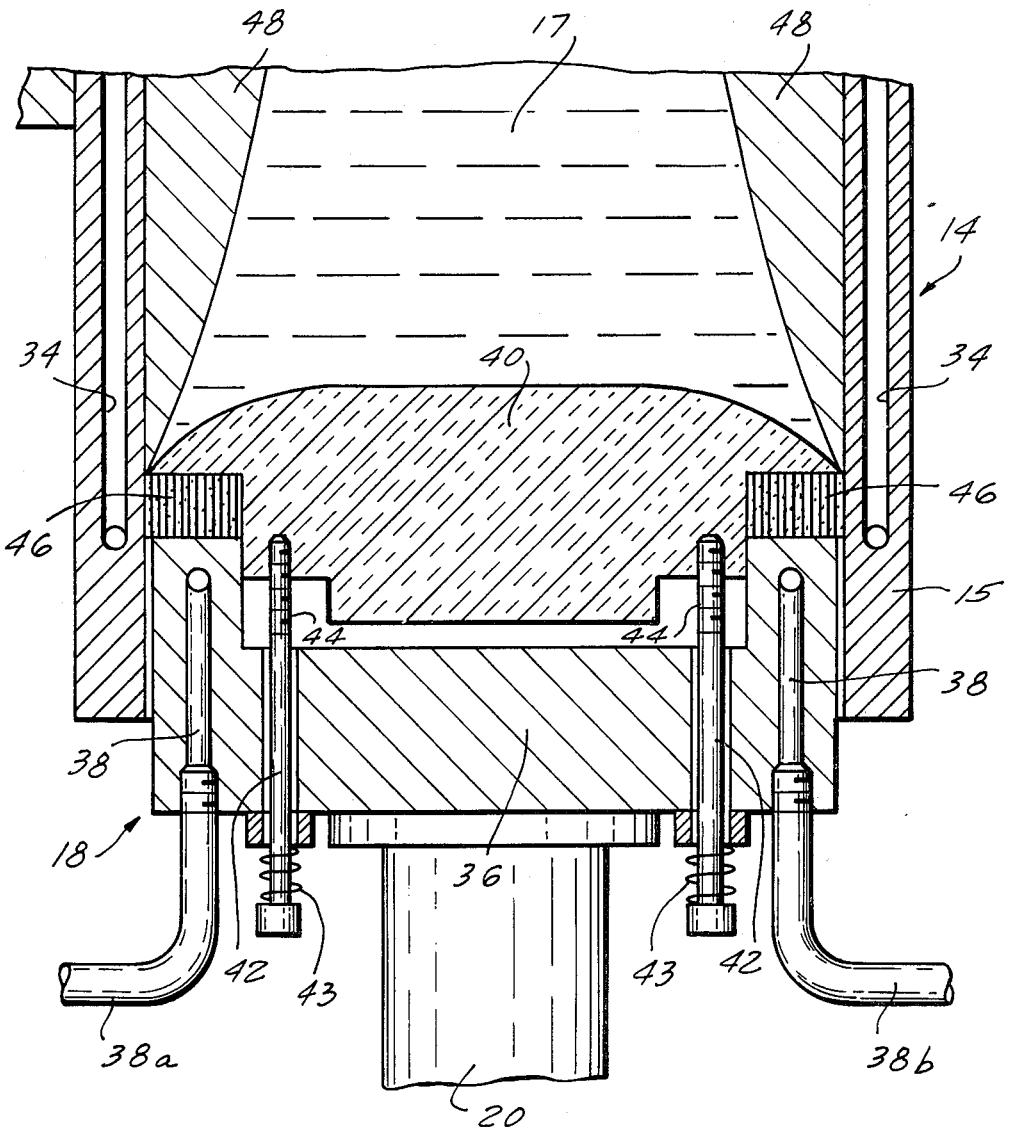
FIG. 3 is an enlarged fragmentary view similar to FIG. 2 illustrating certain details of construction of the mold in FIG. 1.

In FIG. 1, there is shown a container or ladle of molten metal, which ladle is indicated generally at 10 and has a pouring outlet 12 emptying into a vertically arranged mold indicated generally at 14 and having a closed bottom in the form shown. It should be noted that the pouring of molten metal into the mold is in the central region of the mold which is spaced inwardly a substantial distance from the axial wall structure of the mold as shown in FIG. 1. Telescoped into the mold 14 is an annular starting bar 16, the lower portion of which is shown immersed in the molten metal 17 within the mold 14. In the form shown, the starting bar 16 is hollow and fills the cross section of the mold 14. In the condition shown in FIG. 1, molten metal from the outlet 12 of the ladle 10 is being poured into the mold 14 with the starting bar 16 in the position shown in last-mentioned view.

The molten metal is poured directly from the source into the mold 14. By that it is meant, for construction of the appended claims, that the molten metal, though it may be received in the mold through an intermediate supply source, such as the tundish 2 of the aforementioned Tarmann U.S. Pat. No. 3,346,036, it does not contact the starting bar 13 or the hollow tubular casting withdrawn from the mold until the molten metal is in the mold as shown in FIG. 1, to be described hereinafter, unlike the method of U.S. Pat. No. 3,680,624 wherein the molten metal flowing into the mold is supplied by and flows through a solidifying shell of the casting as a molten metal core in contact with the shell and the mold does not serve to supply the metal for the casting.

The lower end of the annular or hollow starting bar 16 is provided with a circular array of circumferentially spaced protruding bolt heads **16*a* on which metal solidifies as the starting bar is withdrawn from the mold as indicated in FIG. 2, to draw the tubular casting in a direction relatively away from the mold 14. The starting bar 16 has a radial flange provided with extensions 16*b* by which the starting bar may be withdrawn as by hooks 19 and 21 respectively engaged with such extensions, and in the illustrated form pulling the starting bar upwardly during the casting operation. In the form illustrated by way of example only, the mold 14 has a stationary support and casting is effected by withdrawing the starting bar 16** from the mold.

The closed end of the mold is indicated generally at 18 which is shown supported on a pedestal 20 in fixed relationship to stationary platform 22. Projecting laterally from the mold 14 is a flange 24 for reciprocating the axial wall structure 15 of the mold 14 for oscillation of the latter during the casting operation from a driving wheel 26. Link 28 interconnects flange 24 and wheel 26 and is pivoted to the latter eccentrically, as at 30 and pivoted to the flange 24 at 32. In accordance with my copending U.S. Pat. application Ser. No. 343,755 filed Mar. 22, 1973, now U.S. Patent No. 3,857,437 mold 14 may have a tapered axial wall structure and the mold may be oscillated in the manner described in that application. However, it is to be understood that the instant invention is not limited to any particular mold configuration or any particular oscillation technique during the casting operation. As shown in FIG. 3, the axial wall structure 15 of the mold 14 is water-jacketed, as at 34, for chilling of such axial wall structure during the solidification of molten metal thereagainst in the casting operation as shown in FIGS. 2, 3. The stationary bottom 18 of the mold has the axial wall structure 15 of the mold 14 oscillating thereagainst during the casting operation. The details of this bottom are best seen in FIG. 3 wherein there is shown a chilled metal head 36, preferably formed of copper, which is suppored on the pedestal 20. For such chilling, the head is jacketed, as at 38, and is provided with a fluid inlet 38a and a fluid outlet 38b coupled thereto to convey water, for example, to and out of the head 36. The construction of the bottom of the mold may be in accordance with my copending U.S. patent application, Ser. No. 419,027, filed Nov. 26, 1973, now U.S. Pat. NO. 3,905,418 but it is to be understood that the present invention is not limited to such construction an arrangement of elements in the mold configuration.

On the face of head 36 remote from the pedestal 20 there is a central recess slideably receiving a stepped face of a refractory element 40, the other face of which is of convex form, and which element may be formed conveniently of boron nitride. The element 40 is exposed to the molten metal in the mold 14. A series of headed bolts 42, biased respectively by compression springs 43, having threaded portions 44 threaded into the element 40 for adjustment of the compression of the springs 43, serve as a holddown device for the element 40 which sandwiches between the latter and the annular periphery of the head 36 an annular series of sealing segments 46 of graphitic material which seal against the interior of the cooled axial wall 15 of the mold 14 to prevent the passage of molten metal therepast. The graphitic sealing segments 46 are cooled by the chilled head 36. As indicated in FIG. 3, the bolts 42 pass with clearance through holes in the head 36 and the compression springs react between the respective heads of the bolts 42 and collars fast on the head 36.

Turning now to the operation of the illustrated apparatus and the method of casting metals such as steel, iron, or other metals and alloys thereof having high melting points, the mold is filled as aforesaid from the container or ladle 10 and the molten metal begins to solidify against the mold wall 15 adjacent to the closed bottom of the mold where the molten metal is exposed to the chilled axial wall 15 of the mold 14, and in so solidifying freezes on the protruding headed bolts **16*a*, whereupon the annular starting bar 16 carrying such bolts is separated relatively from the mold, during oscillation of the mold wall 15, carrying with it the solidifying casting 48 for which the supply of molten metal 17 is located in the mold. As the separation of the starting bar 16 from the mold 14 continues the molten metal in the mold may be replenished as by flow from the container 10 of molten metal which may separate bodily in a direction away from the mold with the starting bar 16, or ladle or container 10** may be removed from the apparatus entirely after filling of the mold, so that the source of molten metal for supply to the tube casting or other hollow cast configuration is supplied solely from the initial filling of the mold as aforesaid.

As indicated in FIG. 2, the thickness of the wall of the casting, which may be of any cross-sectional hollow configuration corresponding to the cross-sectional configuration of the starting bar, increases in a direction toward the top of the mold at least throughout a portion of the vertical dimension of the mold as shown. The axial wall structure of the mold may have a height by way of example and not by way of limitation of 11 inches while the internal diameter of the mold may be three feet, for the casting of elongated hollow articles of large internal dimensions such as pipe for example. It is believed that it has not heretofore been possible to cast sections of large diameter tubing of steel for example.

While plural embodiments of the invention have been described above, it will be apparent, especially to those versed in the art, that the method and apparatus may take other forms and are susceptible to various changes in details without departing from the principle of the invention.

What is claimed is:

1. A method of casting an elongated hollow article utilizing a vertically arranged mold having an oscillatable chilled axial wall structure, comprising:

pouring molten metal by gravity from a source directly into one end of the mold;

relatively separating a starting bar from the mold which starting bar has at least an open end portion immersed in the metal, to withdraw the solidified article adhering to said bar from said end of said mold, during oscillation of the axial wall structure of said mold: and supplying the molten metal for such article from said mold.

2. A method as defined in claim 1, further including closing the end of the mold remote from said molten metal source.

3. A method as defined in claim 1, wherein: during said pouring of said molten metal said starting bar is positioned so that it extends into the mold.

4. A method as defined in claim 1, wherein: said pouring of said molten metal is into the central portion of the mold which is spaced inwardly a substantial distance from said axial wall structure.

5. A method as defined in claim 1, wherein: said pouring of said molten metal is discontinued upon filling of the mold.

6. A method as defined in claim 1, wherein: said pouring of said molten metal includes replenishing the supply of molten metal in the mold during the casting operation.

7. Apparatus for casting an elongated hollow article comprising:

a vertically arranged mold having an oscillatable chilled axial mold structure;

source means pouring molten metal by gravity directly into one end of the mold;

a starting bar having at least an open end portion immersed in the molten metal in the mold;

means to relatively separate said starting bar from said mold to withdraw from said end of the mold the solidifying article adhering to said bar during oscillation of said axial wall structure;

said mold constituting means supplying molten metal for casting the article, said starting bar having means through which said source means pours molten metal through said starting bar.

8. Apparatus as defined in claim 7, further including means closing the end of the mold remote from said source means for pouring molten metal.

9. Apparatus as defined in claim 7, wherein: said axial wall structure has an internal cross-section at least twice the axial dimension of said wall structure, said source means pouring said molten metal into the central region of the mold which is spaced inwardly a substantial distance from said axial wall structure.

10. Apparatus as defined in claim 7, wherein: said source means for pouring molten metal terminates the flow of metal into said mold upon filling of the mold.

11. Apparatus as defined in claim 7, wherein: said source means for pouring molten metal replenishes the molten metal in said mold during said casting operation.

12. Apparatus for casting an elongated hollow article, comprising:

a mold having an oscillatable chilled axial wall structure;

a starting bar having at least an open end nearest said mold;

source means pouring molten metal directly into the mold through said open end;

means to relatively separate said starting bar from said mold to withdraw the solidifying article adhering to said bar during oscillation of said axial wall structure;

said mold constituting means supplying molten metal for casting the article.

13. Apparatus as defined in claim 12, wherein: said means to relatively separate said starting bar from said mold positioning said starting bar to extend into said mold during pouring of said molten metal into said mold at the commencement of the casting operation.

14. Apparatus as defined in claim 12, wherein: said mold is vertically arranged, said means to relatively separate said starting bar from said mold positioning said starting bar to extend into said mold during pouring of said metal into said mold, and said source means for pouring molten metal terminates the flow of metal into said mold upon filling of the mold.

15. A method of casting an elongated hollow article utilizing a mold having an oscillatable chilled axial wall structure and a starting bar having at least an open end thereof nearest the mold, comprising:

pouring molten metal from a source directly into the mold through the starting bar;

relatively separating the starting bar from the mold which starting bar has said open end portion thereof immersed in the molten metal, to withdraw the solidified article adhering to said bar, during oscillation of said axial wall structure of said mold; and supplying the molten metal for such article from said mold.

16. A method as defined in claim 15, wherein: during said pouring of said molten metal said starting bar is positioned so that it extends into the mold.

* * * * *